US011987987B2

(12) United States Patent
Porter

(10) Patent No.: US 11,987,987 B2
(45) Date of Patent: May 21, 2024

(54) INSERT FOR A PANEL

(71) Applicant: Charles Porter, Blythewood, SC (US)

(72) Inventor: Charles Porter, Blythewood, SC (US)

( * ) Notice: Subject to any disclaimer, the term of this patent is extended or adjusted under 35 U.S.C. 154(b) by 343 days.

(21) Appl. No.: 17/345,334

(22) Filed: Jun. 11, 2021

(65) Prior Publication Data

US 2021/0388621 A1 Dec. 16, 2021

Related U.S. Application Data

(60) Provisional application No. 63/038,759, filed on Jun. 13, 2020.

(51) Int. Cl.
*E04F 13/08* (2006.01)

(52) U.S. Cl.
CPC ..... *E04F 13/0835* (2013.01)

(58) Field of Classification Search
CPC ..... E04F 13/0835; E04F 13/0837
USPC ..... 52/506.05
See application file for complete search history.

(56) References Cited

U.S. PATENT DOCUMENTS 2,922,000 A * 1/1960 Larsh ..... H02K 11/23 200/80 R
5,269,499 A * 12/1993 Schwab ..... H01H 5/30 337/365
6,056,519 A * 5/2000 Morita ..... F04B 39/0027 417/415
8,845,202 B2 * 9/2014 Teimel ..... F16F 1/326 384/535
8,960,655 B2 * 2/2015 Wood ..... F02G 1/0435 267/159
10,088,068 B2 * 10/2018 Marocchini ..... F16K 31/0655
10,550,580 B1 * 2/2020 Longo ..... E04F 13/0882
11,493,078 B2 * 11/2022 Aoshima ..... F16B 5/0233
2007/0248436 A1 * 10/2007 Sano ..... B62D 29/048 296/204
2016/0102724 A1 * 4/2016 Potter ..... G01L 5/22 29/896.9

* cited by examiner

*Primary Examiner* — Babajide A Demuren

(57) ABSTRACT

Disclosed is an inset for a panel in the form of a pad or disk for holding supporting the weight of the panel and holding it against a back surface without any means of support for the panel being visible. The insert comprises; one or more spiral shape arms which spiral(s) radially inwards from a perimetral rim inwards toward the center of the insert where the arms have a connector to connect to mounting screw, bolt or rivet. Also disclosed is a panel wall assembly covering a back surface with a panel, comprising: the panel held face to face with the back surface by an out-of-sight insert inset in the panel; a mounting screw/bolt/rivet with a head-flange which protrudes from the back surface; and the insert comprising a connector connected to the head-flange of the mounting screw, bolt or rivet.

11 Claims, 2 Drawing Sheets

INSERT FOR A PANEL

FIELD OF THE INVENTION

This invention relates generally to an inset for a panel. The insert is in the form of a pad or disk for holding supporting the weight of the panel and holding it against a back surface without any means of support for the panel being visible. It is primarily in the field of building construction and architecture and secondarily in other fields where panels are used.

BACKGROUND

Panels are used to improve the aesthetic appearance of building walls, floors and ceilings. An unwanted part on the wall, floor or ceiling is an unsightly fastener used to attach a panel such as a screw head, nail head, clamp or wire.

PRIOR ART

There have been attempts hide a fastener with for example putty over a screw or nail head. However, the putty has a different color and texture than the viewable panel surface, so an overcoat of paint is required.

Another type of attempt to hide the fastener has been install a fastening device on the reverse side of the panel where it cannot be seen. However such fastening devices have suffered from drawbacks such as weak fastening strength, inability to cope with any distortion in the panel over time, difficulty to manufacture in large quantities for a reasonable cost, inability to accommodate repeated attachment and detachment of the panel, and so forth. Example may be found in for example, publications: U.S. Pat. No. 4,332,119 (Norman J. Toews) and U.S. Pat. No. 4,926,606 (Carl E. Hanson).

In light of the foregoing prior art, there is a need for a device to attach a panel to a back surface so that the device cannot be seen, and the panel is held to the back surface and supported with the attachment device being out of sight.

SUMMARY OF THE INVENTION

According to a first aspect of the invention there is an insert for holding to a back surface a panel which screens the insert, comprising; two or more spiral shape arms which spiral radially inwards from a perimetral rim toward the center of the insert where the arms have a connector to connect to a mounting screw, bolt or rivet. The connector may be formed in the terminus of the arms distal from the rim. So the panel may be held to the back surface without the insert being seen.

Due to the/their spiral shape, the arms flex when a radial force is applied to the connector. Movement of connector in the radial direction is thereby accommodated. So, when the head-flange of the mounting screw is connected to the connector, a radial displacement of the mounting screw may be accommodated without the head-flange of the mounting screw being pulled out of the connector.

Due to the/their spiral shape, each arm flexes when a force perpendicular to the arm is applied to the connector. Movement of the connector in the direction perpendicular to the arm and rim is thereby accommodated. This is the direction perpendicular to the major plane of the insert and panel in which it is inset. So, when the head-flange of the mounting screw is connected to the connector, it may be displaced in the direction perpendicular to the arms and rim with the head-flange of the mounting screw being pulled out of the connector.

The insert including the rim, the arms and connector may be a one-piece unit. The insert may be fabricated by molding, 3D printing or other industrial process. The insert may comprise one or a combination of nylon, glass or carbon filled nylon, ertalyte, PEEK, PEKK, ULTEM PVC, polycarbonate, polypropylene, polyurethane, PET, Teflon, acetal, polyethylene, nylatron, ertalon, ASA, ABS, PLA (polylactic acid), PEI, PSU, PPS, PBI, PVC, metal or an alloy or any other material suitable for 3D printing or polymeric material molding or another industrial process. So, the insert may be manufactured in large quantities for a reasonable cost. Also, the material preferably provides the arms ability to flex resiliently.

The connector may be a snap connector. The snap connector may be snap connectable to the mounting screw. It may be snap connectable to the barrel of the mounting screw under the head flange. The snap connector may be snap connectable to the head-flange of the mounting screw. So, a user may be alerted to a connection of the connector to the head-flange by reassuring click. The snap connector may prevent relative moment between connector and the head-flange. So, there is a precisely positioned connection between the insert and the head flange of the mounting screw.

Preferably the connector is formed to snap connect to mounting screw, bolt or rivet having a head-flange. A head-flange includes a screw, bolt or rivet head connected by shaft to a flange.

The connector may be formed in the terminus of the arms distal from the rim. The arms may converge to form the connector into a clamp between the arms. In this way, the arms may converge to clamp the connector around the mounting screw in use. The clamp action may be improved by the connector being configured to snap connect to the mounting screw.

The perimetral rim constrains the arms. Radially inward clamping is modulated by the spiral arms flexible bending in the plane the rim. Preferably the width of each of the arms tapers from the perimetral rim where the arms are widest to the terminus and/or connector where the arms are least wide. The amount of taper affects the flexibility of the arms to bend.

The width of each arm proximate the perimetral rim is preferably at least as wide at the width of the arms at the terminus and/or connector. More preferably the width of each arm at the perimetral rim is between 1.1 and 5 times the width of the arm at the terminus and/or connector. For example, the width at the perimetral may be 1.1 times, 1.5 times, 2 times, 2.5 times or 3 times the width of the arm at the terminus and/or connector. This prevents stress building up in the arms proximate the rim when the connector is displaced. So repeated displacement of the connector does not wear out or crack the arm anywhere between the perimetral rim and the terminus and/or connector. The insert is long lasting and reliable. The stiffness of the arms is also high in an engineered way so that resistance to displacement of the connector is predetermined and an amount of connecting pressure against a head-flange in the connector also high. So, the thickness of the insert may be thinner than otherwise. An advantage of the insert is it is slim.

The insert may be pad shaped like a thin block or the insert may be disk shaped. The perimetral rim of a disk-shaped insert may be ring shaped. The arms spiral in the plane of the perimetral rim and disk or block. The arms spiral radially inward towards the center of the ring to the terminus of the arms where the connector is located.

Preferably the insert has a single and uniform thickness. The thickness being in a direction normal to the plane of the perimetral rim. The thickness of the perimetral rim is preferably the same as the thickness of the arms. The overall outer form of the insert therefore has uniform thickness. It may be easily inserted in a block or disk-shaped cavity in a panel where the depth of the cavity is just greater the thickness of the insert.

The arms may be joined to a side of the perimetral rim. This may be a side which faces radially inwards toward the center of a disk shaped perimetral rim. The joint between the arm and the rim may extend from the top of the perimetral rim to the bottom of the perimetral rim.

When the arm is compressed, the arm presses from top to bottom against the side of the perimetral rim which faces inwards. So there is a very strong connection between the connector and mounting screw/bolt/rive. The arms flex due to their spiral. This compliance allows the arms to reduce seasonal thermals stresses, vibration stresses, and shock stresses due to thermal expansion or sudden or gradual movement of the back surface or the panel. Hence the insert holds the panel reliably to the back surface. The insert to able accommodate displacement of the mounting screw relative to the panel.

Because the arms spiral inward toward the center, the arms have a side which is radially directed outward and faces the side of the perimeter rim which faces radially inwards. The arms(s) also have an opposite side which is radially directed inward toward the center of the perimetral rim.

The radially outward directed side of the arm may join the rim at a first location (A) having a first azimuth. The azimuth is a polar angle as measured with in the plane of the perimetral rim with respect to the center of the perimetral rim. The radially directed inward side of the arm may joins the rim at a second location (B) having a second azimuth and it may also join the connector at the arm terminus at a third location (D) having a third polar azimuth. The azimuth is measured with respect rotation around the center of the insert and/or snap connector. The third azimuth may be intermediate the first and second azimuth. So, there is an imaginary radial line from the center of the perimetral rim though the third location at the arm terminus extending through the arm to the perimetral rim. There is a direct path for compressive pressure through the arm between the terminus where the connector is to the perimetral rim. A head-flange of a mounting screw/bolt/rivet may be compressed very hard in the connector. So, a very strong connection between the connector and mounting screw/bolt/rivet is made.

A more succinct way to express the geometry of the arm which provides the very strong connection between the connector and mounting screw/bolt/rivet may be as follows. The azimuth of the terminus on the inward side of the arm (third location D) is intermediate the azimuths of the locations (first and second locations A and B) where the radially directed inward and outward sides of the arm join the perimetral rim. The arm terminus is at the connector.

To allow the arm to flex when a radial force is applied by a mounting screw to the connector, the azimuth the terminus on the inward side of the arm may be outside of range between the azimuths of the locations where the radially directed inward and outward sides of the arm join the perimetral rim. This improves the ability of the insert to accommodate displacement of the mounting screw.

A balance between required connection strength and ability to accommodate displacement may be accomplished by engineering the position of the third location D with respect to the first and second locations A and B.

Typically, an arm which spirals further around the center of the rim will have more flexibility than arm with spirals less far around. So, the insert may be engineered with more spiral to increase ability to accommodate displacement of a mounting screw/bolt/rivet or displacement of a panel which the insert is inset. Such displacement may result from seasonal changes in humidity or temperature. So preferably the center of the arm between the radially directed inward and outward sides increases in azimuth from where the arm joins to the rim to the terminus of the arm at the connector by an angle between five degrees and 270 degrees. More preferably the angle is 90 degrees. Where the angle is 90 degrees the arm spirals substantially one quarter of the way around the center of perimeter rim. Where the angle is 270 degrees, the arm spirals substantially three quarters of the way around the center the perimeter rim. The increase in flexibility of the arm is due to more bendability due to the increase in arcuate curve of the arm in the plane of the perimetral rim as the amount of spiral is increased. The increase in flexibility is also due to the increase in length of the arm.

Preferably all the arms in insert are identically shaped or nearly identically shaped. Preferably all the arms have the same length from the perimetral rim the terminus where the connector is located. Preferably all the arms have the same width in the azimuthal direction. Preferably all the arms have the same thickness which is preferably the thickness of the insert. Preferably all the arms spiral the same amount around the center of the perimetral rim. Preferably the arms are equally spaced apart.

All the arms may bend simultaneously to displace the connector in the plane of the rim. In plane bending is enabled by the spiral of the arms. The more the amount of spiral, the more the amount of in plane flexibility of the spiral arms there tends to be.

An amount of out of plane bending is also possible because the arms can also bend inward and outward.

The connector, which may be a snap connector, may be formed with a socket in it located substantially at the center of the insert. The connector may be arranged to connect to the head-flange of the mounting screw/bolt/rivet inserted perpendicular to the arms and to the perimetral rim.

The connector may comprise a hub with which all the arms merge. The socket may be formed in the hub.

The arms may remain separated their terminuses where they collectively form a connector. Each arm may be configured to compress directly against a mounting screw/bolt/rivet in the connector. So pressure may be applied by the arms to the mounting screw/bolt/rivet without the constraint of a hub. Since the arms transfer compression the perimetral rim from top to bottom a very strong connection is made which holds the mounting screw between the arm terminuses. This is a much better connection than could be made by a hub that was connected to only the top or bottom of the perimetral rim. It is also more accommodating of thermal or shock stresses than only radially straight arms without any spiral around the center.

The connector may be a snap connector which comprises a radially inward pointing protuberance at the terminus of each arm distal from the perimetral rim. Preferably the protuberance includes vee shaped wedge with the tip edge aligned parallel with the plane of the perimetral rim. So, when the head-flange is inserted into the snap connector the vee shaped wedge snaps into position between the head and the flange.

The vee shaped wedge at the terminus of each arm may be separate from vee shaped wedge at the terminus of the other arms. Each wedge may press against the head-flange and the pressure is resisted by the other wedges. So, a very strong connection is made which holds the mounting screw between the arm terminuses.

According to a second aspect of the invention there is a panel wall assembly covering a back surface with a panel held to the back surface by an insert described herein, comprising: the insert, the panel, and the mounting screw with the head-flange.

The panel wall assembly may, comprise: the panel held face to face with the back surface by an out-of-sight insert inset in the panel; a mounting screw/bolt/rivet with a head-flange which protrudes from the back surface; and the insert comprising a connector connected to the head-flange of the mounting screw, bolt or rivet.

In the panel wall assembly, the insert is inset in a blind cavity in the panel which has an opening through a first surface held face to face with the back surface, and the insert may be disposed intermediate the back surface and a second surface of the panel that is opposite the first surface. So the second surface screens the insert which is connected by the connector to the mounting screw protruding from the back surface.

Due to features of the insert and how it is inset in the panel, the assembly may be rapidly and inexpensively constructed. The panel may be attached and detached repeatedly from the back surface. The panel may be held flush against the back surface. The panel may be attached and detached repeatedly to the back surface by pressing the panel against back surface and pulling the panel away from the back surface. The insert accommodates distortion of the panel over time without the connection becoming loose. So, the panel remains safely attached to the floor, wall or ceiling back surface even if temperature or humidity variations distort the panel.

The panel wall assembly may include also include at least a second panel also held face to face with the back surface by an out-of-sight second insert inset in the second panel; a second mounting screw with a head-flange which protrudes from the back surface; and the second insert comprising a second connector connected to the head-flange of the second mounting screw. The second insert is the same as the first. The second panel may be directly adjacent to the first panel.

According to third aspect of the invention there is a manufactured veneer for covering a back surface comprising: the insert described herein, and the panel. The panel may be opaque or comprise an opaque material to screen the insert.

The perimetral rim of the insert may be attached to the panel or fixed to the panel or constrained within the panel. The spiral arms may flex within the plane of the perimetral rim. The insert may be attached the veneer with a co-planer orientation.

The manufactured veneer may comprise the: the panel; and the insert inset in the panel; the insert comprising the connector connectable to the head-flange of a mounting screw, bolt or rivet.

The manufactured veneer may supplied ready made to a construction site in sufficient quantity to rapidly and inexpensively attach each panel with insert to the back surface. A floor, wall or ceiling may be then covered with panels with inserts. In this way a panel wall assembly may be made conveniently.

Preferably the insert is inset in a cavity in the panel. The cavity may be a blind cavity although alternatively it may penetrate through the panel. The manufactured veneer may comprise an exterior sheet which covers the cavity.

The blind cavity may have an opening through a first surface of the panel to be held face to face with the back surface. The first surface may be the reverse of a second surface of the panel and/or of the veneer to be exposed when the first surface of the panel is held to the back surface. The second surface may have a finish for exterior use. The second surface may be directly on the panel, or it may be on an exterior sheet.

The insert may be pad shaped like a thin block or the insert may be disk shaped. The profile of the block may polygonal. The profile of the disk may be round, circular or oval. Preferably the major plane of the panel and the major plane of the insert are parallel when the insert is inset.

The cavity may have an outline to match the profile of the insert, and so facilitate a press fit. The insert may be inset into the panel so that the profile of the block or disk is visible in the first surface.

The insert may be inset flush with the panel. The depth of the blind cavity may exceed the thickness of the block or disk so that inset may be inset into the cavity by a distance equal to the thickness. This whole insert may be flush with panel. Alternatively, the spiral arm and/or the perimetral rim may be flush the first surface. So the panel may be held flush against the back surface by the connector connected to the mounting screw.

The insert may be press fit in the cavity. The perimetral rim of the insert is pressed and against the side of the cavity. Thus the panel may be securely attached to the insert by friction. The spiral arms extending spirally inwards from the perimetral rim may be free within the perimeter of the rim to flex. This helps to ensure secure connection to the mounting screw even if the mounting screw position shifts due to shock, vibration, or thermal expansion/contraction or moisture expansion/shrinkage of the panel. It helps to secure the panel near to the back surface.

The manufactured veneer may be made by molding a panel. The panel may be molded with the cavity. It is also possible to route or drill the cavity out of a panel and then pressing the insert into the cavity.

There may be a dimension across the blind cavity which is less than a dimension across the insert prior to the insert being inset in cavity to provide a friction connection of the insert to the panel. For example, the diameter or width of the cavity opening may be less than the diameter or width of the insert before the insert is inserted into the cavity. The dimensional interference between the panel and insert provides a preselected removal force of the insert from the panel. Preferably the removal force is greater than the force required to pull out the head-flange of the mounting screw from the connector. Preferably the rim of the pad and perimeter of the cavity opening have the same shape and matching size.

The panel may comprise wood, particle board, plywood, polymeric material, concrete, masonry, ceramic, metal, drywall board, gypsum board, sponge board, foam board or another material. Preferably the material is able to maintain a form of a panel. Preferably the material sufficient strength for the panel to be supported by the inset and held against the back surface and maintain the shape of a panel.

The panel may be at least 0.1-inch (2.5) mm thick. More preferably the panel is at least 1 inch (25 mm) thick. Preferably the thickness of panel exceeds the thickness of the insert plus a margin for space between the inset and the bottom of the blind cavity. So, the insert may inset into the panel in the first surface which is the reverse of a second surface to be exposed when the panel is held to the back surface.

For example, in a manufactured veneer with insert, there may be an insert 0.375 inch (9.5 mm) thick inset in a blind cavity in the panel which may be 0.44 inch (11 mm) deep. The panel may be 0.5 inch (12.7 mm) thick.

An insert may have a form of a polygonal, circular or oval pad or disk. The thickness of the insert may be the thickness of the pad or disk. The thickness may be at least 0.08 inch (2 mm) thick. The thickness may be at most 12 inches (300 mm) thick. Preferably inserts have a thickness which is between 0.25 inch (6.3 mm) and 0.625 inch (16 mm). More preferably the thickness is 0.375 inch (9.5 mm). The blind cavity and panel are correspondingly deeper and thicker than the insert thickness. An advantage of the insert is that is slim so to that the panel which the insert supports may also be slim. So a thin panel may have a blind cavity to hide the insert from view when the panel is hung and held by the insert inset in the blind cavity.

The panel may be at least 1 inch (2.5 mm) long and 1 inch (2.5 mm) long. Preferably the panel is substantially 4 feet wide (1.2 m) and 8 feet long (2.4 m).

Preferably the insert(s) are located proximate the edges of the panel. Each insert may be located proximate a respective corner of the panel the panel.

In a manufactured veneer with insert the connector may be orientated to receive the mounting screw with a head-flange presented perpendicular to the major plane of the panel.

According fourth aspect of the invention there is a method of constructing a panel wall assembly to cover a back surface with a panel, including steps of: providing the panel having an insert in a cavity, wherein the insert comprises connector to connect to a mounting screw; fixing the mounting screw to the back surface so that the screw protrudes; placing the panel face to face with the back surface where the snap connector aligns with the screw; and pressing the panel toward the back surface until the screw connects to the connector.

The is no need to press and drop the panel to make the connection. The panel can be pressed straight on to the back surface with just one motion direction. The panel having the insert is also easy to remove from the back surface by pulling the panel straight away from the back surface.

The mounting screw may alternatively be a bolt or rivet or another device which may be fixed to protrude from the back surface.

The connector may be a snap connector to connect to a head-flange of the device which protrudes from the back surface. Preferably the method includes pressing the panel toward the back surface until the head-flange snap connects to the snap connector.

The method may include a step of preparing a template to locate the position where the mounting screw is to be fixed to the back surface. Alternatively, the method may include a step of a step of inserting a removable alignment pin into the snap connector and pressing the panel toward the back surface until a tip of the pin makes a mark where the mounting screw is to be fixed to the back surface.

The method may include a step of forming the blind cavity in a side of the panel opposite the side of the panel visible when pressing the panel toward the back surface. Preferably this includes forming the blind cavity with a dimension across the cavity less than a dimension across the rim of the insert prior to insertion by an amount sufficient for an interference fit of the insert in the cavity. Preferably this also includes forming the cavity deeper in the direction toward the blind bottom than the thickness of the insert. There may also be a step of pressing the insert into the blind cavity to a position where the insert is flush with the cavity opening edge.

According to fifth aspect of the invention there is a kit of parts for constructing the panel wall assembly, including: the mounting screw/device and the insert described herein. Preferably the insert is inset in the panel. Preferably the kit includes a suction cup to attach to the panel and to pull the panel away from the back surface. Preferably the kit includes an alignment pin comprising a cylinder to partially insert into the connector of the insert wherein the pin has a marking tip co-axial with the cylinder.

According to a sixth aspect the invention there is an elevator passenger or cargo box comprising the panel wall assembly according to the invention.

The invention will now be described, by way of example only, with reference to the accompanying drawings in which:

DETAILED DESCRIPTION OF THE INVENTION

Figure 2:
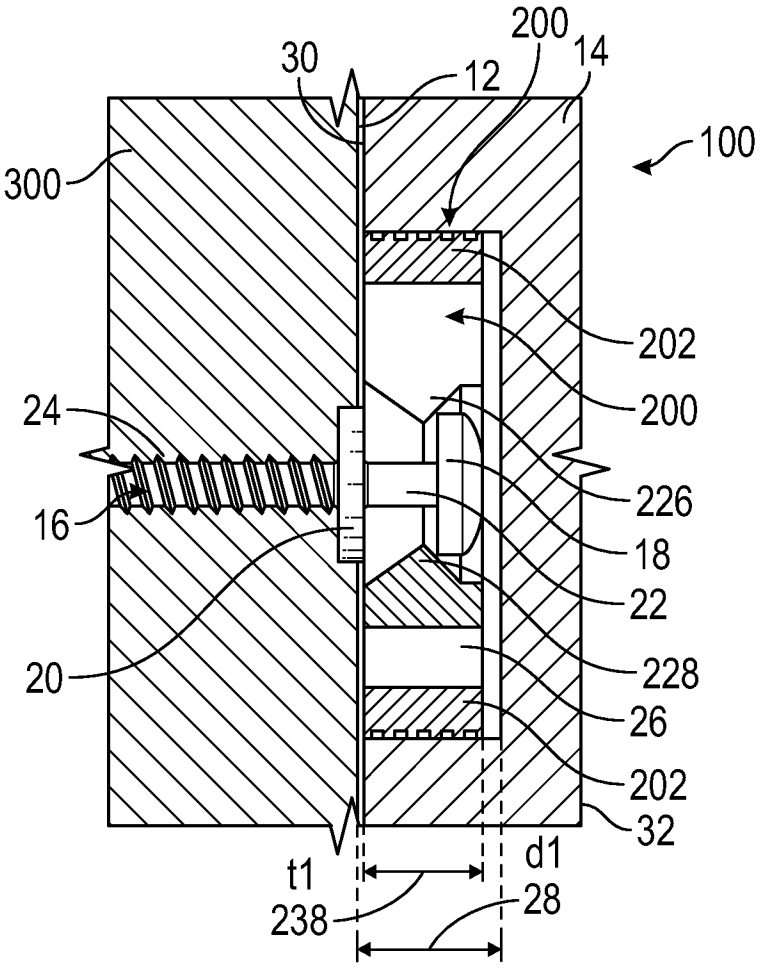
FIG. 2 is a cutaway cross section view showing a panel wall assembly having a panel including an inset insert according to the invention.
Figure 1:
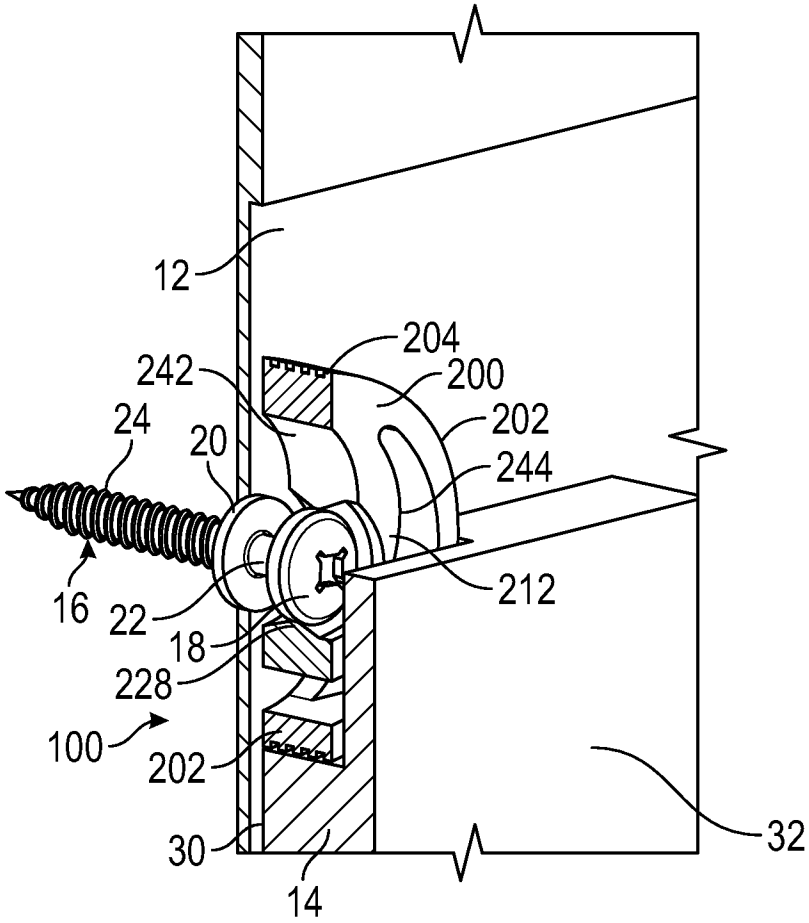
FIG. 1 is a cutaway perspective view showing a panel wall assembly having a panel including an inset insert according to the invention.

Referring to the Figures, there is shown in FIG. 1 and in FIG. 2 a panel wall assembly 100. The panel wall assembly 100 covers a back surface 12 with a panel 14. The back surface 12 is typically an unfinished surface of a floor, wall or ceiling. For example, the back surface 12 could be a surface of a steel wall in an elevator passenger box. Another example of the back surface is a surface of a concrete wall or drywall in a building.

Figure 3:
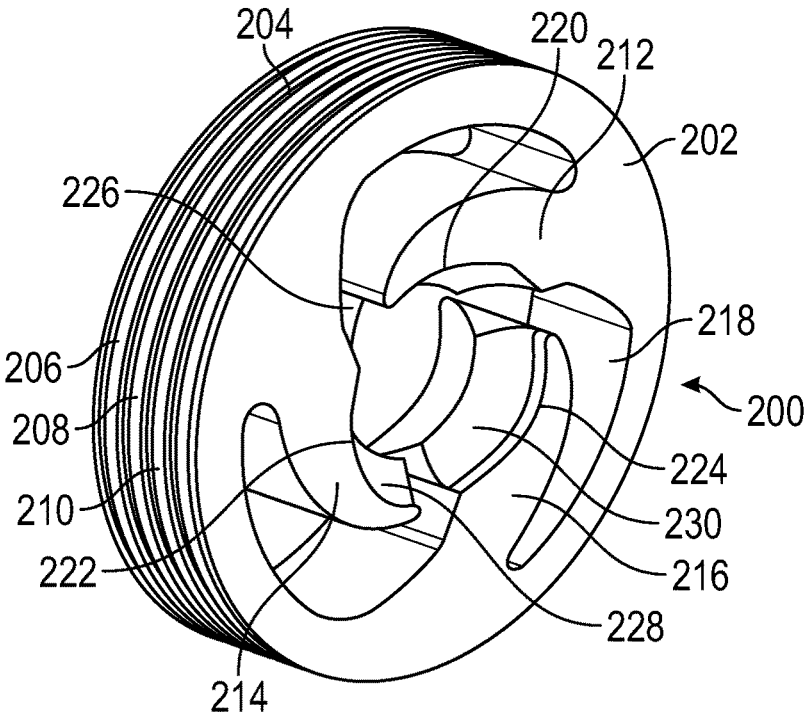
FIG. 3 is a perspective view showing an insert according the invention.
Figure 4:
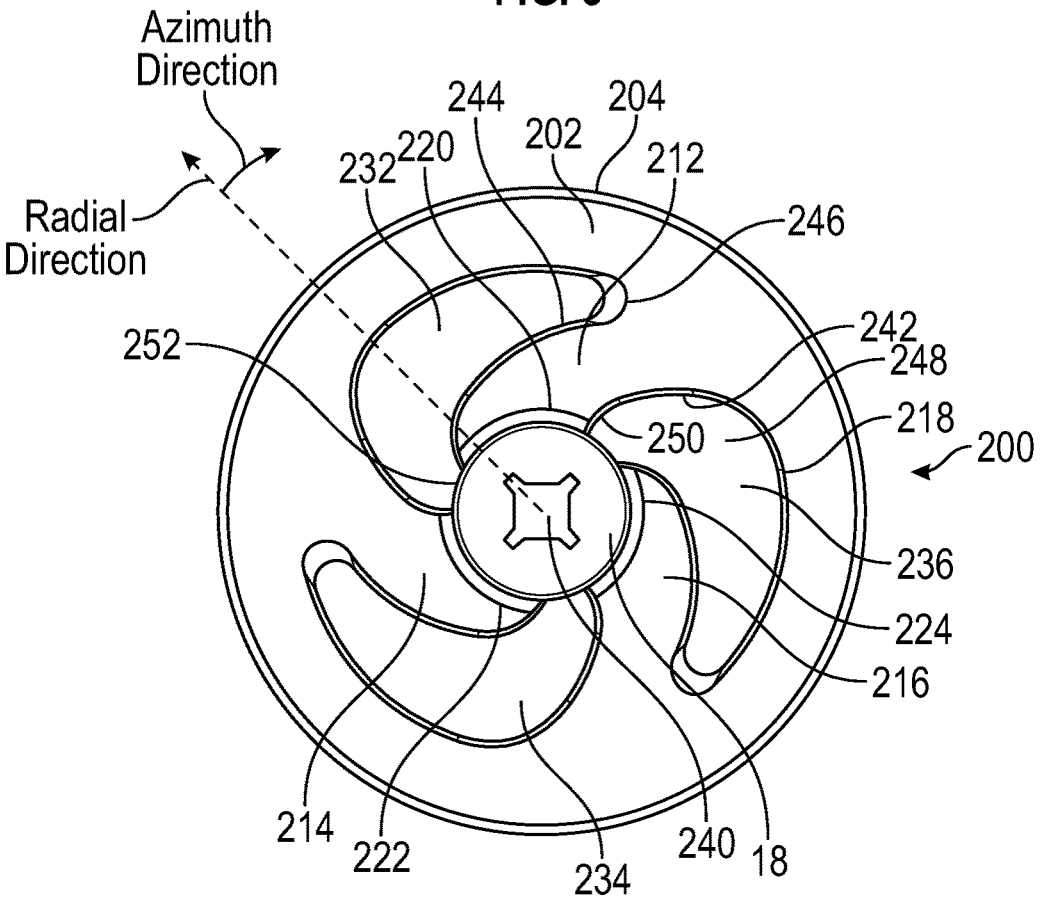
FIG. 4 is a face on view showing an insert according to the invention.

As shown in FIGS. 1 and 2 the panel wall assembly comprises: the panel 14 held face to face with the back surface 12 by an out-of-sight insert 200 inset in the panel 14. In FIGS. 3 and 4 the insert 200 itself may be seen.

As shown in FIGS. 1 and 2, the panel wall assembly 100 includes a mounting screw 16. The mounting screw 16 has a head-flange. The head-flange includes the head 18 of the mounting screw 16. The head-flange also includes a flange 20 around a shank 22 of the mounting screw 16. The flange 20 is located intermediate the thread 24 of the screw 16 and the head 18 of the screw. The head-flange protrudes from the back surface 12.

As shown in FIGS. 3 and 4 the pad-like insert 200 is disk shaped. The disk-shaped insert has a ring shape perimetral rim 202. The radially outermost side of the perimetral rim 202 is a cylindrical surface 204. There are circumferential ridges 206, 208, 210 on the circumferential cylindrical surface 204. The circumferential ridges are angled to let the insert be pressed easily into a cylindrical blind cavity having a slightly smaller diameter, but the angle makes the ridges strong resist pull out of the insert from the blind cavity.

As shown in FIGS. 3 and 4, the insert 200 comprises three spiral shaped arms 212, 214, 216. All three arms 212, 214 216 have the same shape. The three arms 212, 214, 216 are each individually joined to the ring shaped perimetral rim 202. The three 212, 214, 216 are joined to the radially facing inward side 218 of the perimetral rim.

Each arm 212, 214, 216 spirals inwards from the ring shaped perimetral rim 202 of the insert 200. Each arm 212, 214, 216 spirals in the major plane of the of the disk-shaped insert 200 and its ring-shaped perimeter rim 202. Each arm 212, 214, 216 spiral inwards toward the center of the insert 200, but none of the arms reach the center of the disk-shaped insert 200. So, by a pictorial analogy, the inward spiral of the arms 212, 214 216 look like arms of a spiral star galaxy spiraling inwards toward center of the galaxy where there is a black hole.

As shown in FIGS. 3 and 4, the first arm 212 has a first terminus 220 proximate the center of the perimetral rim 200 and insert 200. The terminus 220 is at the distal end of the first arm 212 from where it is joined to the perimetral rim 200. Since the second arm 214 and the third arm 216 have the same shape as the first arm 212. So, there is an identical second terminus 222 at the distal end of the second arm 214 and an identical third terminus 216 at the distal end of the third arm 216.

As shown in FIG. 2 and FIG. 3, joined to and part of each terminus 220, 222, 224 is a vee shaped connector 222, 224, 226. This is a snap connector which clicks into the space between the head 18 and the flange 20 of the mounting screw 16. In this way the insert 200 is connected to the head-flange of the mounting screw 16. The mounting screw 16 is perpendicular to the spiral arms 212, 214, 216, the perimetral rim 202 and the major plane of the disk-shaped insert 200.

Between each arm 212, 214, 216 there is a space 232, 234, 236. Each arm is separate from the others. The terminus 220, 222, 224 of each arm presses individually against the head-flange of the mounting screw 16. Consequently, the mounting screw 16 is connected very securely to the insert 200.

As can be seen in the cross-section view of FIG. 2, the insert 200 has a thickness, t, 238. The perimetral rim 202 has the same thickness, and all three arms 212, 214, 216 have the same thickness. So, when the arms 212, 214, 216 are compressed against the head-flange the arms press from top to bottom across the entire circumferential cross section of the perimetral rim and against the side of the perimetral rim which faces radially inwards.

As can be seen in FIG. 1 and FIG. 2, the panel 14 has a blind cavity 26 which is disk shaped in which the disk-shaped insert 200 is inset. Before the disk-shaped insert 200 inset, it 26 has as diameter larger than the diameter of cavity 26 to provide an interference fit. The insert 200 is comprised of material which is relatively more compliant than the panel 200. So, the insert 200 is squeezed to a smaller diameter to fit into the cavity. Alternatively, or conjunction with this, the insert 200 has circumferential ridges 206, 208, 210 which brush against the cavity cylindrical wall as the insert is inset. The ridges 206, 208, 210 are directed to permit the insert 200 to be inset into the cavity but resist removal.

As can be seen in FIG. 1 and FIG. 2, the panel has a first surface 30 which is the reverse of a second surface 32. The first surface 30 is face to face with the back surface and is covered by the panel 14. The second surface is exposed and visible. The second surface is on an especially nice-looking layer of the panel 14. The blind cavity 26 makes an opening in the first surface 30. It is blind because it does not penetrate through the second surface 32.

As can be seen in FIG. 2, the blind cavity 26 has a depth d1 28 into the panel 14 which is greater than the thickness of the insert t1 238. The insert 200 is flush in with the panel 14. The perimetral rim 202 and three spiral arms 212, 214, 216 are flush with the first surface. This enables the first surface 30 of the panel 14 to be flush with the back surface 12. The snap connector vee shape 226 connection with the head flange holds the panel 14 securely flush with the back surface 12. It is not necessary, though it is possible, for the vee shape connector 226 to be located on the terminus 220 so that the back surface 12 will be held directly against the first surface 30.

As shown in FIG. 4, polar coordinates are established from the center 240 of the disk-shaped insert. These consist of a radial distance from the center and a polar angle azimuth around the center.

As shown in FIG. 4, the first arm 212 has a radially directed outward side 244 and a radially directed inward side 242. The first arm 212 is arcuate as are its outward side 244 and inward side 242. The outward side 244 joins the perimetral rim 202 at a first location (A) 246. The inward side 242 joins the perimetral rim 202 at a second location (B) 248. The inward side 242 joins the connector 226 at the arm terminus denoted third location (C) 250. The outward side 244 joins the connector 226 at the arm terminus denoted fourth location (D) 252.

The azimuth of the third location 250 is intermediate the azimuth of the first location 246 and second location 248. So, there is an imaginary radial line from the center 240 though the third location 250. The imaginary radial line continues through the first arm 212 to the perimetral rim 202. So, there is a direct path for compressive pressure through the first arm 211 from the perimetral rim to the terminus 220 where first arm joins the connector 226. So, for the purpose of clamping the mounting screw between the connectors, the arms are firm.

As shown in FIG. 4, each arm 212, 214, 216 spirals about sixty degrees around the center 240 of the perimetral rim 202. The azimuthal difference between first location A 246 where the outward side 244 of the first arm 212 joins the perimetral rim 202 and the first arm terminus at fourth location D 252 on the outward side is about sixty degrees. The azimuthal difference between second location B 248 where the inward side 242 of the first arm 212 joins the perimetral rim 202 and the first arm terminus at third location D 250 on the inward side is about sixty degrees. This makes arm wider proximate the perimetral rim than proximate the terminus.

As shown FIG. 4 each arm 212, 214, 216 extends as a cantilever from the perimetral rim 202 to the terminus 220, 222, 224 where it has a connector 226, 228, 230. The length of the cantilever increases with the amount of the spiral. So, a radial force applied by the mounting screw 16 to the connectors 226, 228, 230 causes the arms 212, 214, 216 to flex. Since the arms are flexible, they can accommodate displacement of the mounting screw.

INDEX OF LABELLED FEATURES IN FIGURES

Panel wall assembly . . . 100
Back surface . . . 12

Panel . . . 14
Mounting screw . . . 16
Head of mounting screw . . . 18
Flange of mounting screw . . . 20
Shank of mounting screw . . . 22
Thread of mounting screw . . . 24
Blind cavity in panel . . . 26
Depth of blind cavity . . . 28
First surface of panel . . . 30
Second surface of panel . . . 32
Insert . . . 200
Perimetral rim . . . 202
Cylindrical surface of perimetral rim . . . 204
Circumferential ridges . . . 206, 208, 210
Spiral arm 1 . . . 212
Spiral arm 2 . . . 214
Spiral arm 3 . . . 216
Perimetral rim radially inward facing side . . . 218
Terminus of spiral arm 1 . . . 220
Terminus of spiral arm 2 . . . 222
Terminus of spiral arm 3 . . . 224
Vee connector of spiral arm 1 . . . 226
Vee connector of spiral arm 2 . . . 228
Vee connector of spiral arm 3 . . . 230
Space 1 between arms . . . 232
Space 1 between arms . . . 234
Space 1 between arms . . . 236
Thickness of insert . . . 238
Center of disk-shaped insert . . . 240
First arm radially facing inward side . . . 242
First arm radially facing outward side . . . 244
First arm outward side first location A by rim . . . 246
First arm inward side second location B by rim . . . 248
First arm inward side third location C by terminus . . . 250
First arm outward side fourth location D by terminus . . . 252

The invention has been described by way of examples. Therefore, the foregoing is considered as illustrative only of the principles of the invention. Further, since numerous modifications and changes will readily occur to those skilled in the art, it is not desired to limit the invention to the exact construction and operation shown and described. All suitable modifications and equivalents may be resorted to.

The invention claimed is:

1. A manufactured veneer for covering a back surface, comprising an insert for holding to the back surface a panel which screens the insert; said insert comprising two or more spiral shape arms which spiral radially inwards from a perimetral rim toward the center of said insert where the arms have a connector to connect to a head-flange of a mounting screw; and said manufactured veneer also comprising said panel.

2. The manufactured veneer according to claim 1 wherein the perimetral rim is fixed to the panel and the spiral arms are able to flex within the perimeter of the rim.

3. The manufactured veneer according to claim 1 wherein the connector is orientated to receive the mounting screw presented perpendicular to the major plane of the panel.

4. The manufactured veneer according to claim 1 comprising an opaque material to screen the insert.

5. The manufactured veneer according to claim 1 wherein the insert is inset in a blind cavity in the panel.

6. The manufactured veneer according to claim 5 wherein the rim of the insert is press fit in the blind cavity.

7. The manufactured veneer according to claim 5 wherein the blind cavity has an opening through a first surface of the panel to be held face to face with the back surface.

8. The manufactured veneer according to claim 7, wherein the panel comprises a second surface opposite to the first surface, wherein the second surface has a finish for exterior use.

9. A panel wall assembly covering a back surface with a panel held to the back surface by an insert, wherein said panel screens said insert; said insert comprising two or more spiral shape arms which spiral radially inwards from a perimetral rim toward the center of said insert where the arms have a connector to connect to a head-flange of a mounting screw; said panel wall assembly comprising: said insert, said panel, and said mounting screw with said head-flange.

10. The panel wall assembly according to claim 9 wherein the insert is inset in a blind cavity in the panel which has an opening through a first surface held face to face with the back surface, and the insert is disposed intermediate the back surface and a second surface of the panel that is opposite the first surface so that the second surface screens the insert which is connected by the connector to the mounting screw protruding from the back surface.

11. A kit of parts for constructing a panel wall assembly, including: an insert for holding to a back surface a panel which screens said insert, and a mounting screw with a head-flange; said insert comprising two or more spiral shape arms which spiral radially inwards from a perimetral rim toward the center of said insert where the arms have a connector to connect to said head-flange of said mounting screw.

* * * * *